United States Patent [19]

Bloder

[11] 4,359,139

[45] Nov. 16, 1982

[54] LIFESAVING APPARATUS FOR ROPING DOWN PERSONS

[76] Inventor: Hans Bloder, Wienerstrasse 46/I, A-8605 Kapfenberg, Austria

[21] Appl. No.: 173,686

[22] Filed: Jul. 30, 1980

[30] Foreign Application Priority Data

Jul. 31, 1979 [AT] Austria ..... 5248/79

[51] Int. Cl.[3] ..... A62B 1/10

[52] U.S. Cl. ..... 182/234; 182/238; 182/240

[58] Field of Search ..... 182/5, 6, 7, 238, 231, 182/234, 235, 240; 188/65.4, 65.5

[56] References Cited

U.S. PATENT DOCUMENTS

| | | | |
|---|---|---|---|
| 194,471 | 8/1877 | Schultz | 182/5 |
| 482,813 | 9/1892 | Schwarz | 182/6 |
| 933,685 | 9/1909 | Wray | 188/65.5 |
| 2,479,459 | 8/1949 | Bassett | 182/234 |
| 2,576,755 | 11/1951 | Gaskins | 182/235 |
| 3,188,052 | 6/1965 | Longworth | 182/234 |
| 3,669,223 | 6/1972 | Arnold | 188/65.4 |
| 3,739,875 | 6/1973 | Clark-Padwicki | 188/65.4 |
| 3,799,287 | 3/1974 | Ledner | 182/5 |
| 3,826,341 | 7/1974 | Ledner | 182/5 |
| 3,946,989 | 3/1976 | Tsuda | 182/5 |
| 3,949,832 | 4/1976 | Hunter | 182/7 |

*Primary Examiner*—Reinaldo P. Machado
*Attorney, Agent, or Firm*—Browdy and Neimark

[57] ABSTRACT

A life saving equipment for roping down persons along a rope has a rack with an inlet opening and an outlet opening for the rope so that the rope passes the rack when the person is roped down. A rope pulley is rotatably mounted within the rack and has on its circumference a groove for the rope. The rope is guided in the groove for a looping angle of more than 180°. The rope pulley can be braked by at least one brake member, the braking force of which can be adjusted by a setting mechanism influenced by the weight of the person to be roped down. A monitoring means checks the presence of the rope within the rack and has a movable sensor member pressed again the rope, preferably by means of at least one spring. The sensor member acts on a rope clamping device for clamping the rope when a rope shortage occurs.

23 Claims, 19 Drawing Figures

12
13
82
84
79'
91
68
91
86
87
88
89
61
11
90

121
122
123
124
125
127
126
120
119
114
117
118
116
79
h
33
115
88''
8
91
91'
90'
90
89
88
88'
61

LIFESAVING APPARATUS FOR ROPING DOWN PERSONS

FIELD OF THE INVENTION

The present invention refers to a life saving apparatus for roping down persons.

BACKGROUND OF THE INVENTION

It is known that in case of fire accidents, persons staying in higher floors can frequently not be secured in time. Rescue hoses, safety nets and air cushions are not readily applicable for higher floors and subject to the known risks.

SUMMARY OF THE INVENTION

It is an object of the invention to provide a simple apparatus for rescueing persons captured in higher stories of a building without any problems in case of a fire accident or other dangerous situations. It is a further object of the invention to make such an apparatus more reliable in operation. It is another object of the invention to improve an apparatus of the kind described above such that the person roping down can adjust the velocity of this roping down. It is another object of the invention to avoid an accident if the rope is too short to allow the person roping down to reach the road level. It is still another object of the invention to provide means to avoid that the velocity of roping down can increase beyond a predetermined value.

An apparatus according to the present invention comprises a rack being passed by a rope to be connected to the person to be roped down, and a rope pulley rotatably supported within said rack and being provided on its sircumference with a groove within which the rope is guided for a looping angle of more than 180°, at least one brake member for being pressed against the rope pulley, a setting mechanism for adjusting the braking force by the person to be roped down, and a monitoring device checking the presence of the rope within said rack and having a sensor member being movably supported and pressed against the rope, which sensor member is operatively connected to a rope clamping device in case of a rope shortage. Such a device is immediately ready for operation and one can start with roping down persons (optionally also animals or goods) without having to wait the arrival of the fire brigade or other auxiliary personnel. The equipment can easily be operated and can be used repeatedly because it can always be brought back to the site of use, for example by means of a backhaul cable. The person to be rescued can itaself adjust the braking action on the rope pulley in the desired manner so that varying body weights of different persons to be roped down can be taken in consideration. If the rope is too short or if the rope has a dangerous constriction, the monitoring device for the rope does give a response for interrupting the progress of roping down by actuating the rope clamping device. Accidents are thus avoided. It is of additional advantage that one end of the rope is downwardly depending and can be pulled off the building by an auxiliary person, so that roping down need not be effected in vertical direction and the person to be roped down can be brought out of the influence of the flames, smoke and so on.

Preferably the rope monotoring device is arranged at that area of the rack where the rope enters the rack for providing ample space for arranging the rope clamping device. Further, it is convenient to press the sensor member against the rope by means of at least one spring so that the sensor member will reliably engage the rope also with inclined positions of the life saving equipment. For still further improving blocking of the life saving equipment in case of a response of the rope monitoring device, the rope monitoring device may also act on a lock pawl engaging a serration of the rope pulley and fixing the rope pulley. Thus, in case of a response of the rope monitoring device, not only the rope becomes clamped by by the rope clamping device but also the rope pulley becomes blocked so that the rope, in view of the great looping angle conveniently exceeding 345°, is also retained by the rope groove of the rope pulley.

A particularly favourable embodiment of the invention results if the setting mechanism varying the braking force is provided with a clamp bolt extending outwardly from the rack and pressing on movement in axial direction brake lining discs against a brake disc non-rotatably connected to the rope pulley, noting that for moving the clamping bolt a nut is provided screwed onto a thread of the clamp bolt and being supported on an abutment connected to the rack, said nut being coupled to a constructional part being movable relative to the rack and being acted upon by the weight of the person to be roped down against the action of a spring.

SHORT DESCRIPTION OF THE FIGURES OF THE DRAWINGS

Various embodiments of apparatus according to the invention are shown schematically and by way of examples in the accompanying drawings.

Figure 1:
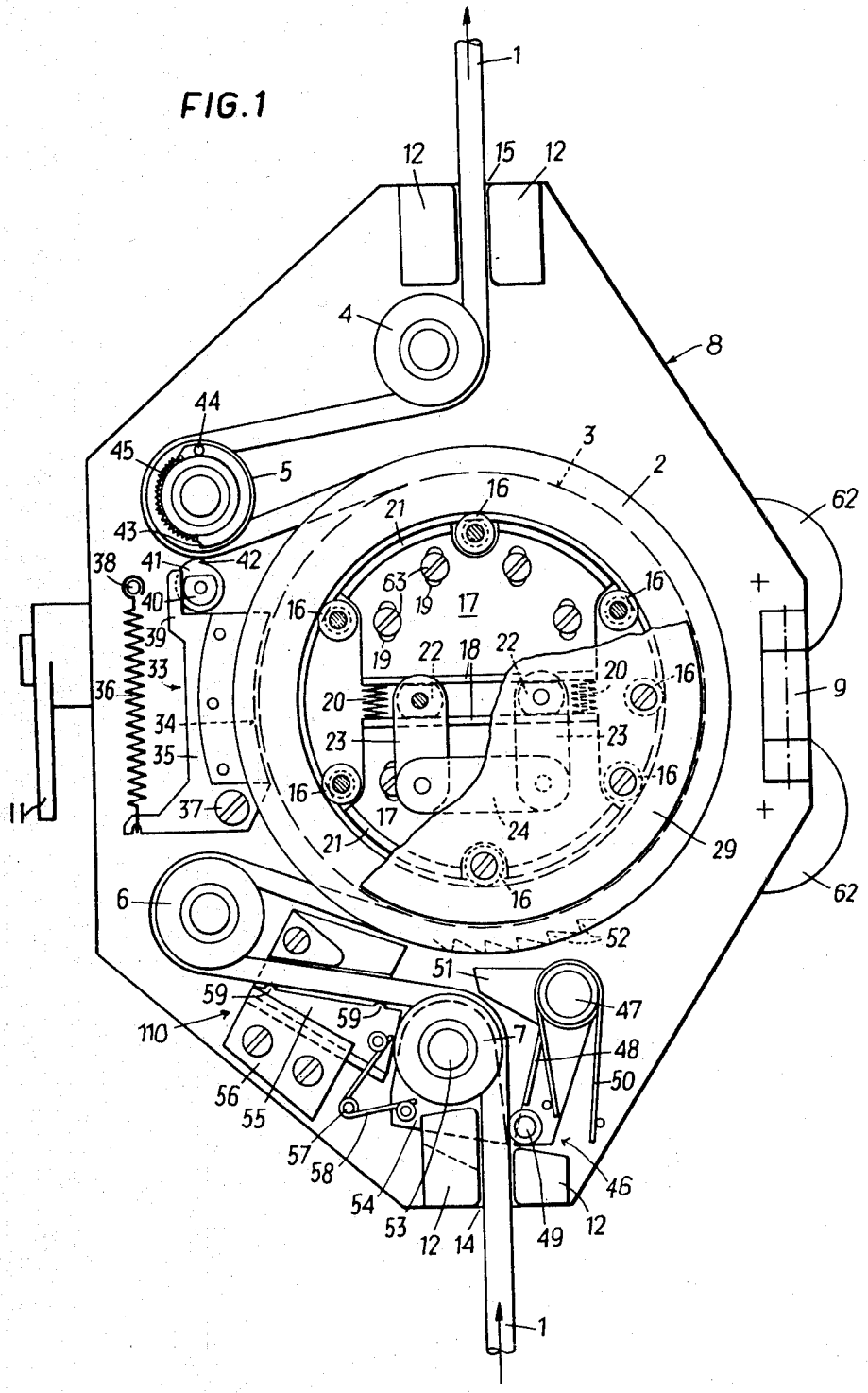
FIG. 1 shows a first embodiment, partially in a section, with the housing cover removed.
Figure 4:
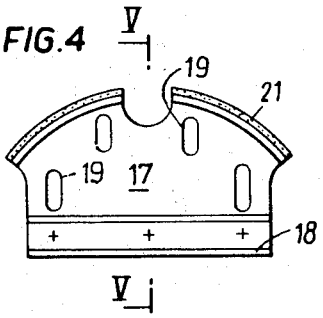
FIG. 4 shows a brake shoe suitable for braking the rope pulley.
Figure 5:
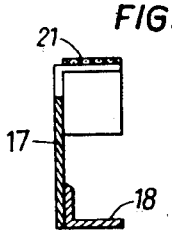
FIG. 5 is a section along line V—V of FIG. 4.

The rope 1 is guided within a wedge-shaped rope groove 3 of a rope pulley 2 for a looping angle of more than 180° and the rope pulley 2 can be subjected to a braking action. For guiding the rope 1, guide pulleys 4, 5, 6 and 7 are provided which are, as is the rope pulley 2, rotatably supported on a base plate 8 of a rack. The base plate 8 is connected with a cover plate 10 of the rack by means of a hinge 9 so that the plates 8 and 10 enclose and protect the constructional parts located therebetween. Said both plates 8 and 10 can be locked in closed position by means of a locking lever 11 and are carrying guiding blocks 12, 13 which, in pairs, define a lower inlet opening 14 and an upper outlet opening 15 for the rope 1. The rope pulley 2 is given the shape of a ring which is rotatably supported on the base plate 8 by means of seven supporting rolls 16. The greater number of supporting rolls 16 is arranged on the looping side of the rope pulley for better counteracting the pressure exerted by the rope 1. For braking the rope pulley 2, two brake shoes 17 are arranged within the rope pulley 2 and facing one another with their rear side. These brake shoes 17 are facing one another with flanges 18 (FIGS. 1, 4 and 5) rivetted to the brake shoes. Four screw bolts 63 extend through elongated holes 19 for guiding the brake shoes and maintaining same in the desired position. The axes of the supporting rolls 16 extend laterally of the brake shoes 17. Thus, the brake shoes 17 can be moved one from the other but a pivotal movement of each of the brake shoes 17 is impossible. Said both brake shoes 17 are moved one from the other by means of two compression springs 20 interpositioned between the flanges 18 such that the brake linings 21 (FIGS. 4 and 5) of these brake shoes are brought in engagement with the inner circumference of the rope pulley 2. This results in a braking action on the rope pulley 2 in dependence on the pressure exerted by the springs 20. To be in the position to increase the braking action at will, two eccentrics or cams 22 are positioned between said both flanges 18 and connected with their axes in a rigid manner with levers 23 linked one with the other by means of a connecting link 24 such that both levers 23 can only be pivoted in the same sense of rotation and for the same extent. This results in a uniform outward movement of both brake shoes 17 by engaging said brake shoes 17 at two points such that both flanges 18 always assume a relative parallel position and canting of the brake shoes 17 is prevented.

Figure 2:
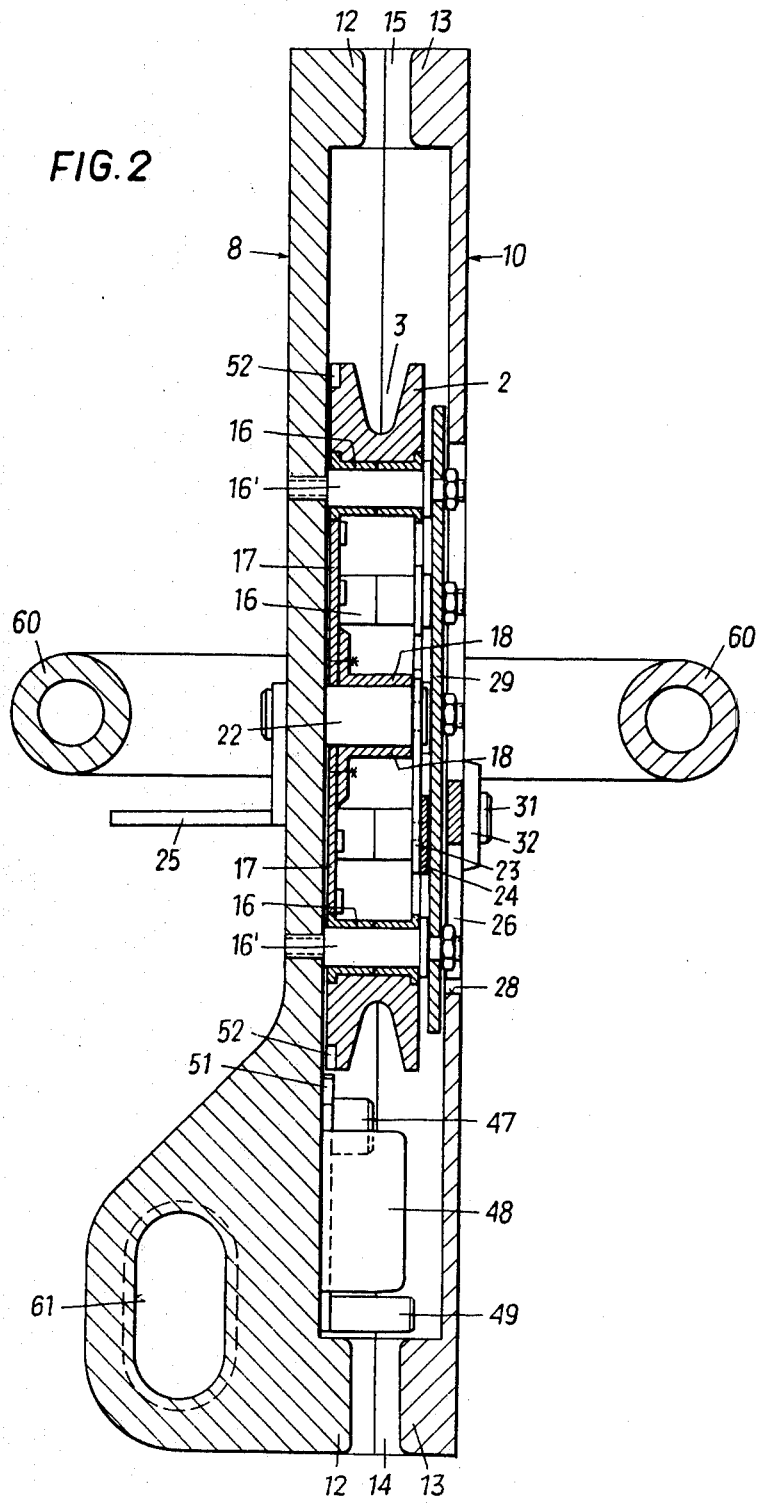
FIG. 2 is a vertical cross section through FIG. 1 with the rope removed.

An adjusting lever 25 (FIG. 2) is connected to the axis of one of the eccentrics or cams 22, said adjusting lever 25 being arranged at the outer side of the base plate 8 and being actuable by the pressure of a finger of the person to be roped down. This does result in a more or less braking action of the brake shoes 17.

Figure 6:
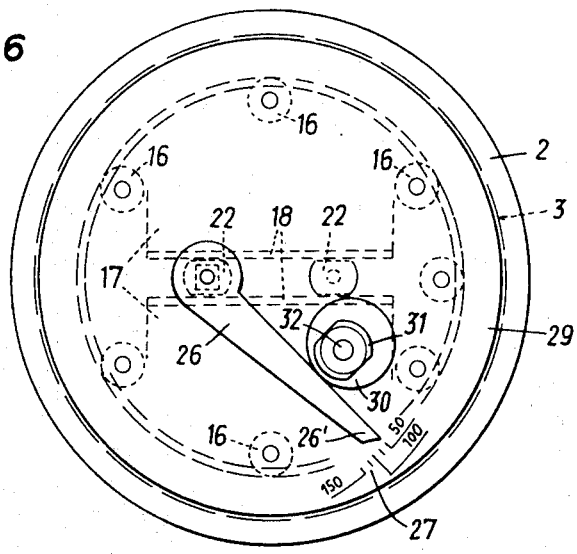
FIG. 6 shows the setting mechanism for adjusting the braking force in a view taken from the outer side.

Additionally thereto, a pre-adjusting means for the braking force of the brake shoes 17 is provided. For this purpose a pivotal lever 26 (FIGS. 2 and 6) is non-rotatably connected with the axis of one of the eccentrics or cam 22. This pivotal lever 26 can be adjusted through a window 28 provided in the cover plate 10 and has its end 26' formed as an index cooperating with the graduation 27 graduated in kilograms. For adjusting the minimum braking force corresponding to the body weight of the person to be roped down, a cam plate 30 is pivotally supported on an axis 31 provided on a supporting plate 29 which can be seen through the window 28 provided in the cover plate 10. An actuating knob 32 is non-rotatably connected to the cam plate 30. The cam plate 30 is engaging the pivotal lever 26 so that by adjusting the actuating knob 32 the pivotal position of the pivotal lever 26 can be selected and the spreading force acting on the brake shoes 17 can be adjusted.

If the person to be roped down is not in the position to perform the above described operation, a centrifugal force brake 33 becomes operative at a predetermined speed of roping down movement. This centrifugal force brake has a brake shoe 34 cooperating with the outer circumference of the rope pulley 2 and being located on an auxiliary brake lever 35 which is pivotally supported on an axis 37 positioned on the base plate 8 and which is pressed against the rope pulley 2 by a strong tension spring 36 fixed to the base plate at 38. On normal operation, said auxiliary brake lever 35 is prevented from exerting a braking action by means of a protrusion 39 engaging a disengageable release nose 40. The release nose 40 is formed of a roller provided with a flattened area and laterally carrying a disc 41 having a protrusion 42. This protrusion 42 can pass past an abutment 43 formed of a half-ring pivotally arranged on an axis 44 at the side face of the guide roll 5 and be maintained in a position near to the axis by means of a tension spring 45, and this protrusion 42 can pass said abutment 43 as long as the speed of roping down movement is relatively low. On attaining high numbers of revolution of the guide roll 5, the centrifugal force acting on the abutment 43 becomes so great that said abutment is moved against the action of the tension spring 45 in radially outward direction to such an extent that this abutment does engage the protrusion 42 of the disc 41 and does thus swivel the release nose 40 to such an extent that a flattened area 46 is facing the protrusion 39 of the auxiliary brake lever 35. The auxiliary brake lever 35 can now perform a pivotal movement in direction to the rope pulley 2 so that the brake shoe 34 carried by the lever 35 can be pressed into the tapering rope groove 3 of the rope pulley 2 with a pressure defined by the spring 36 and can perform the desired braking action.

Figure 3:
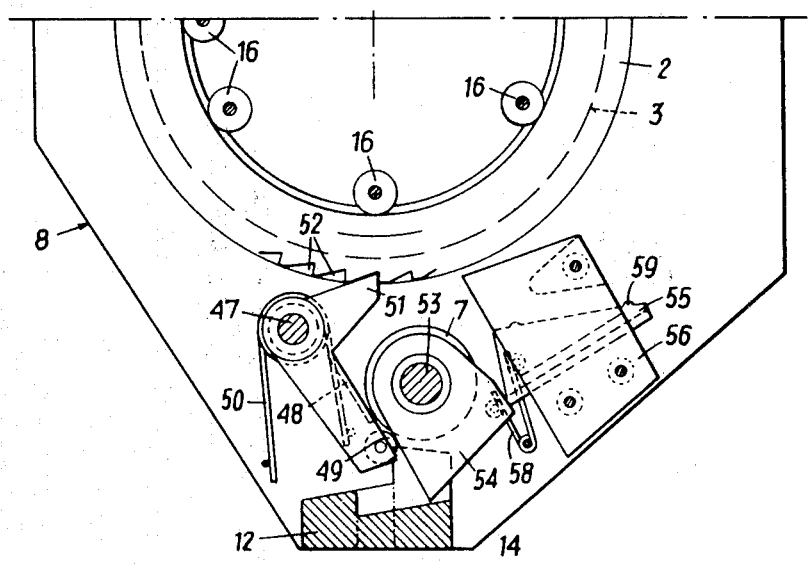
FIG. 3 shows, partially in a section, a detail seen from the rear side of FIG. 1.
Figure 7:
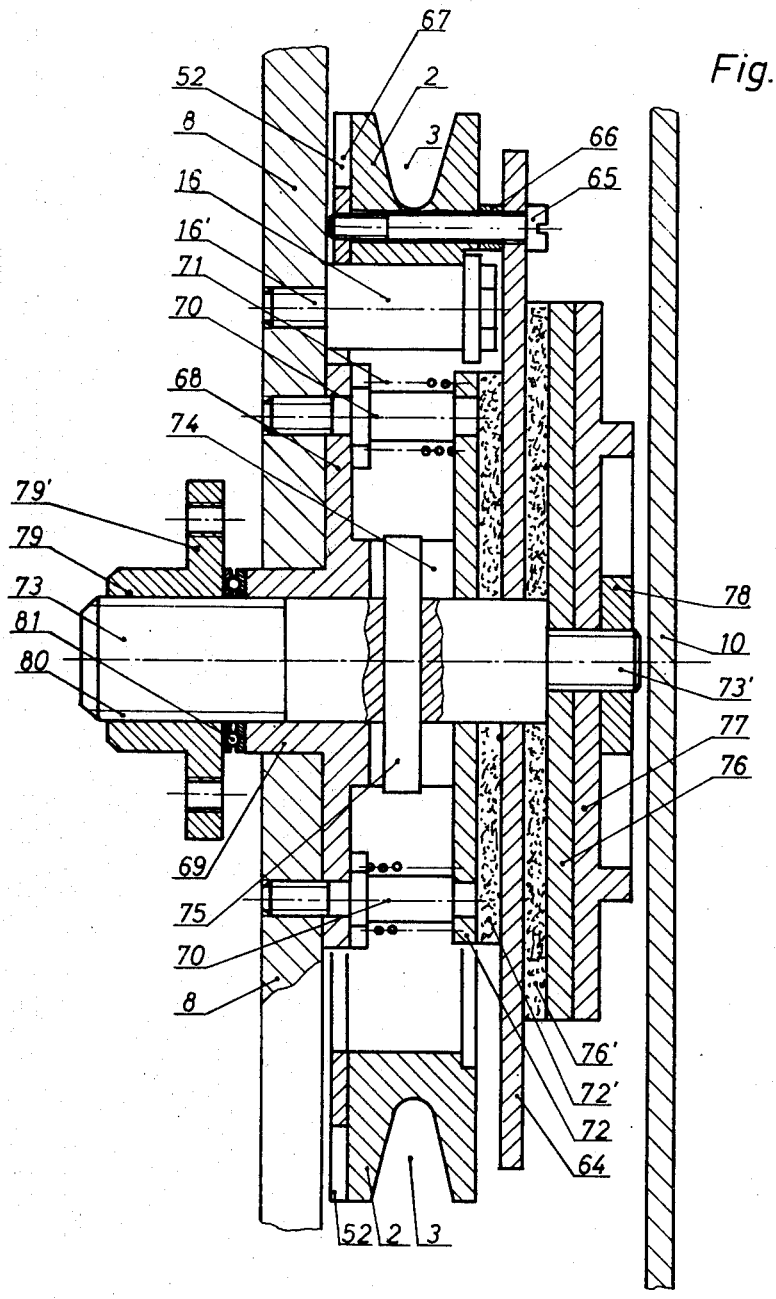
FIG. 7 shows, similar to FIG. 2, a second embodiment in a greater scale and in a vertical cross section.
Figure 8:
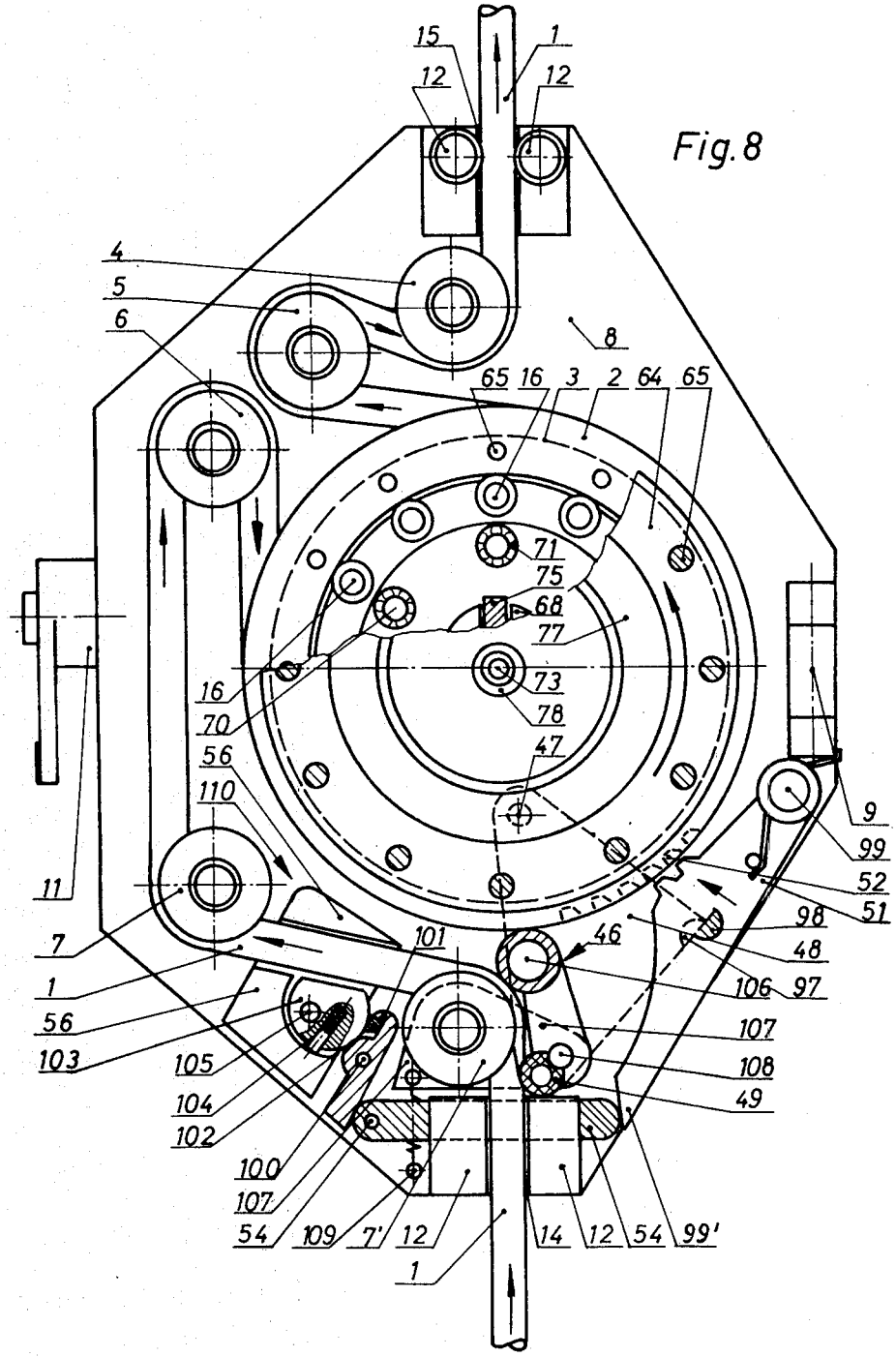
FIG. 8 shows, similar to FIG. 1, a view of the second embodiment, partially in a section.
Figure 9:
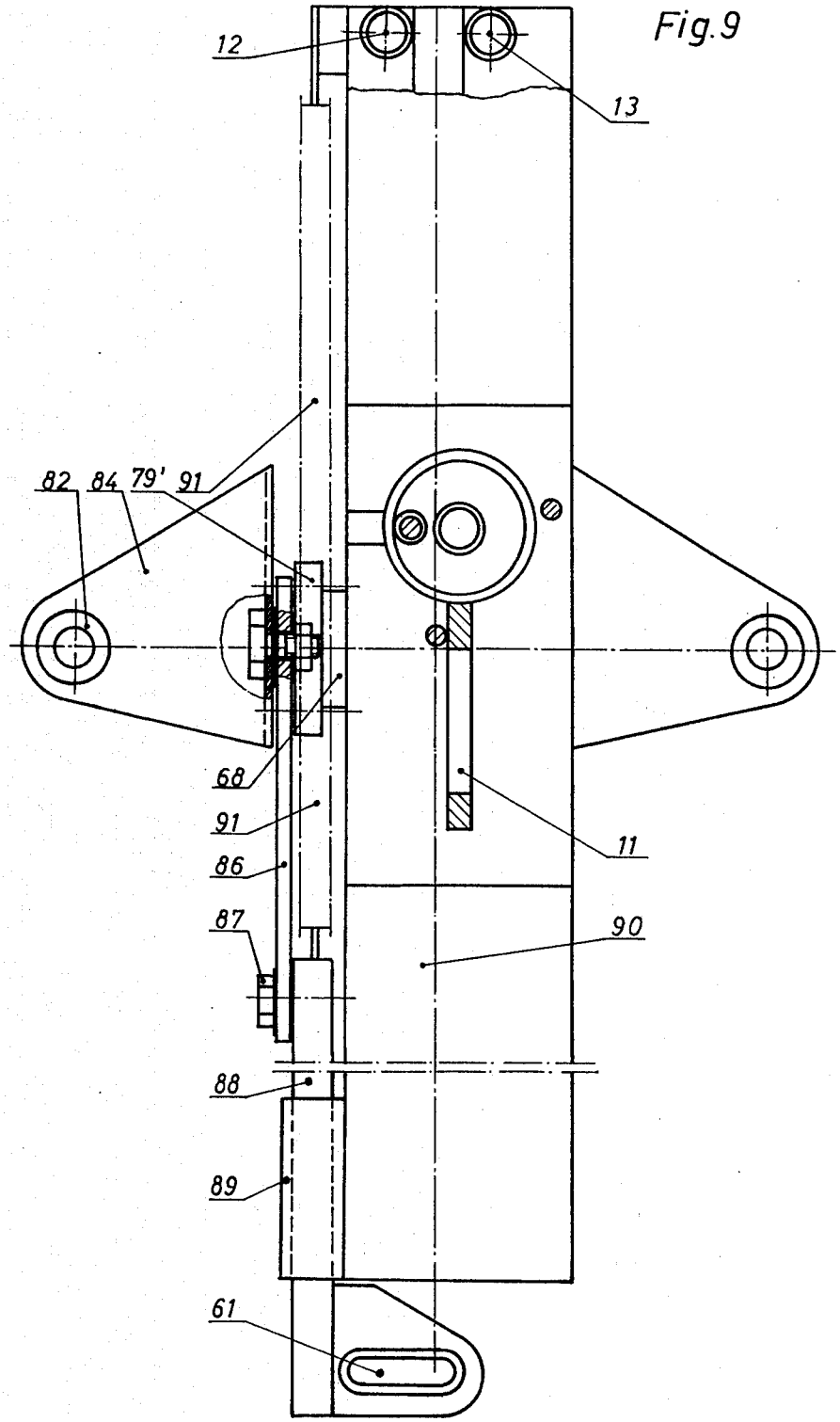
FIG. 9 is a side-view of the rack, partially in a section.
Figure 10:
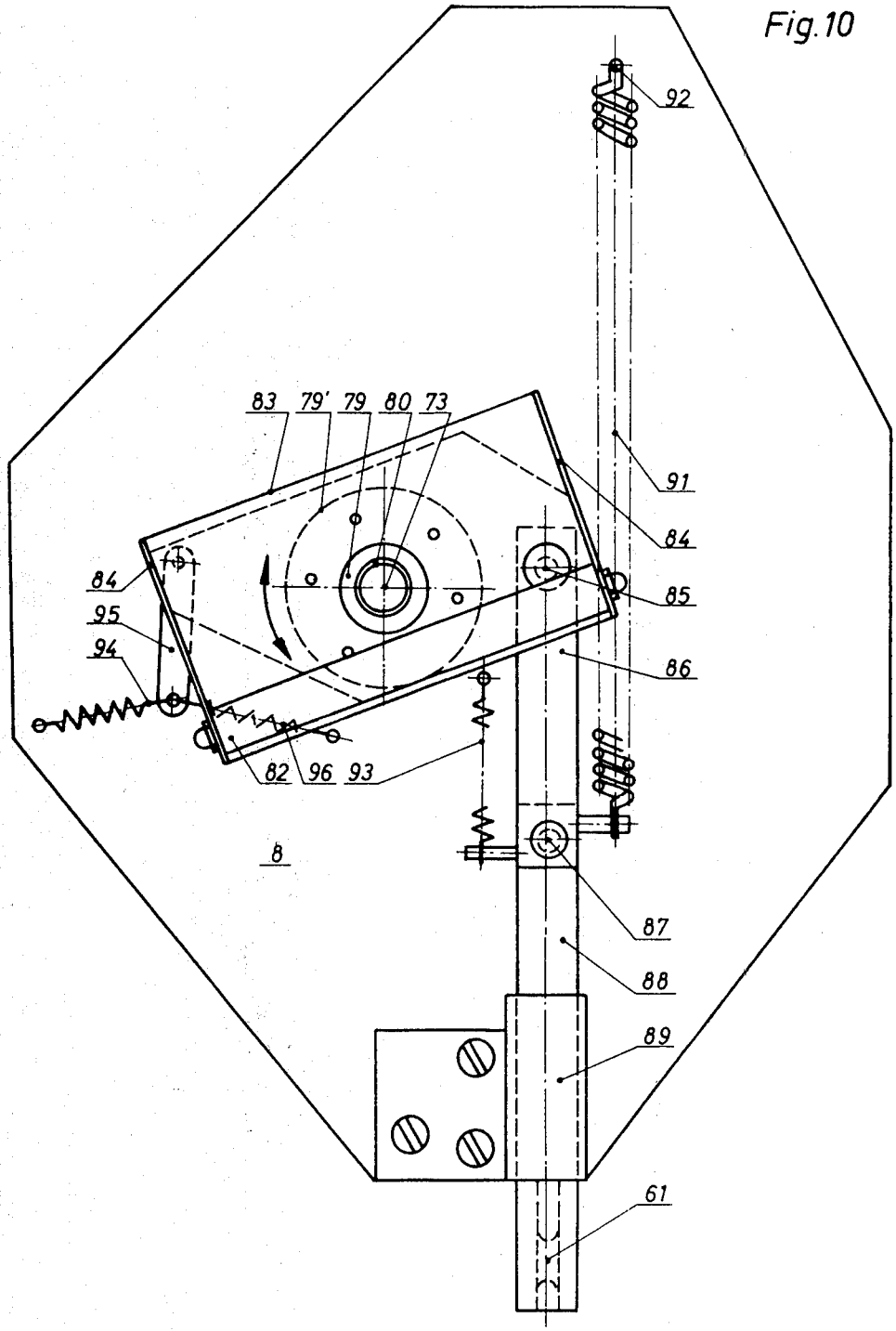
FIG. 10 shows a view of the setting device for the braking force.
Figure 11:
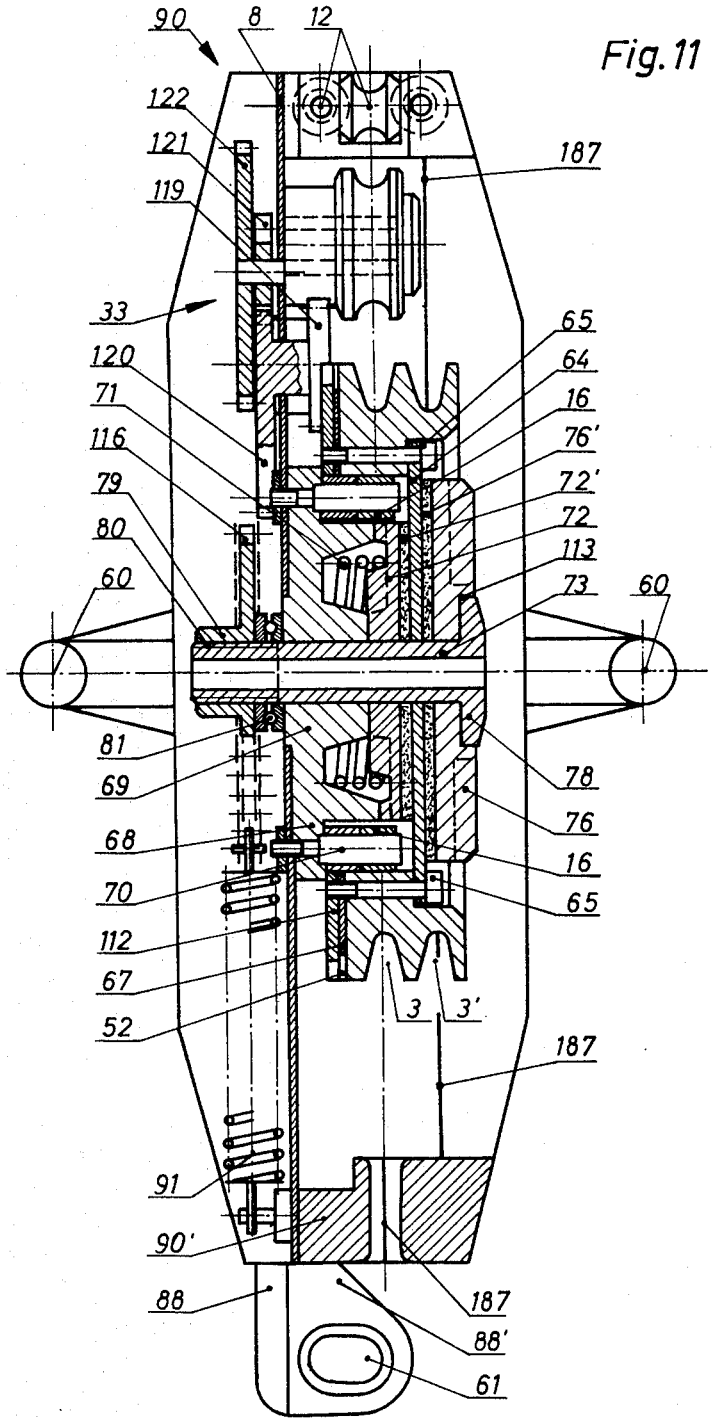
FIG. 11 shows, similar to FIG. 2, a third embodiment in a vertical cross section.
Figure 12:
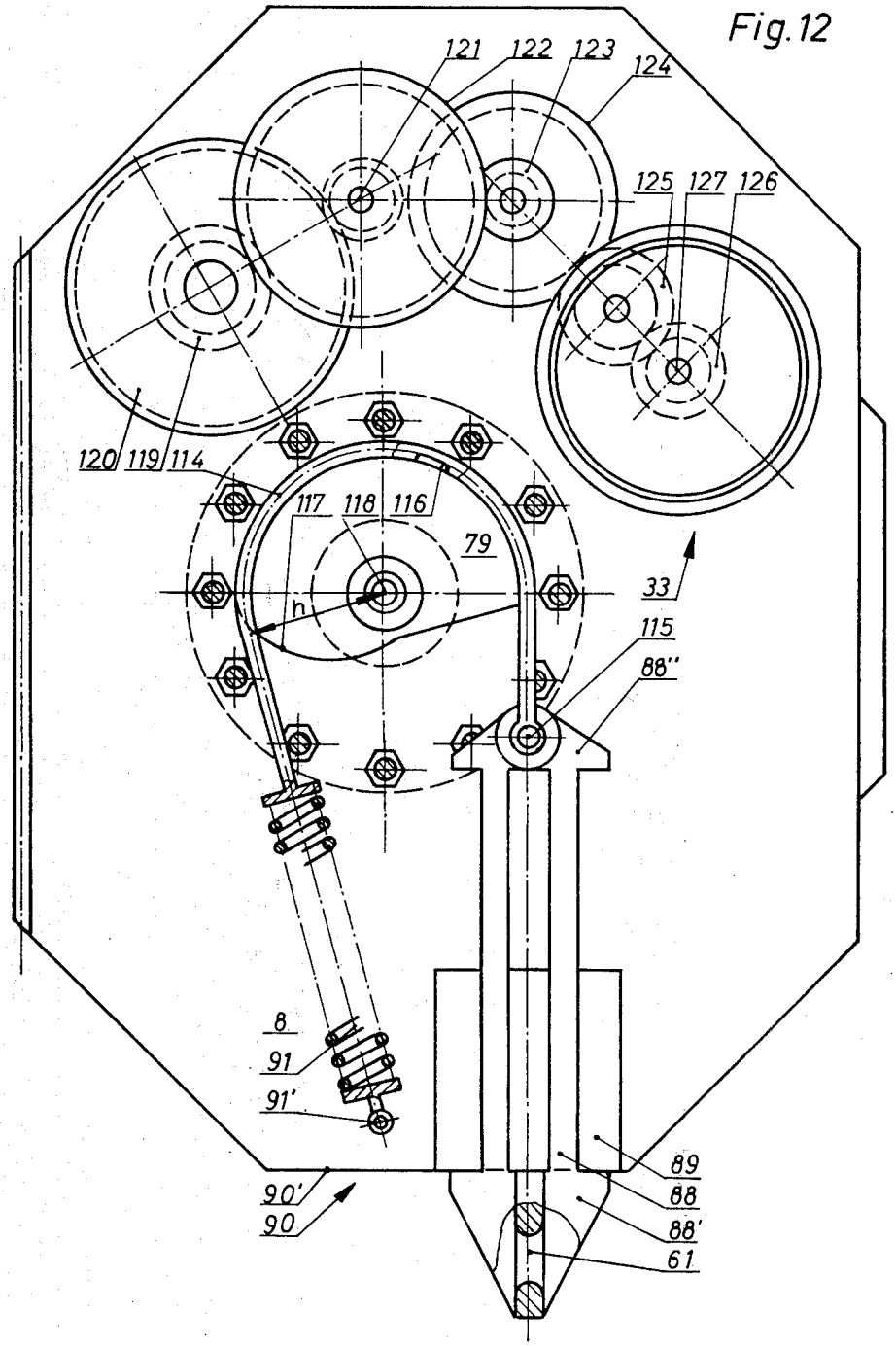
FIG. 12 is a view of the setting device, partially in a section, for adjusting the braking force.
Figure 13:
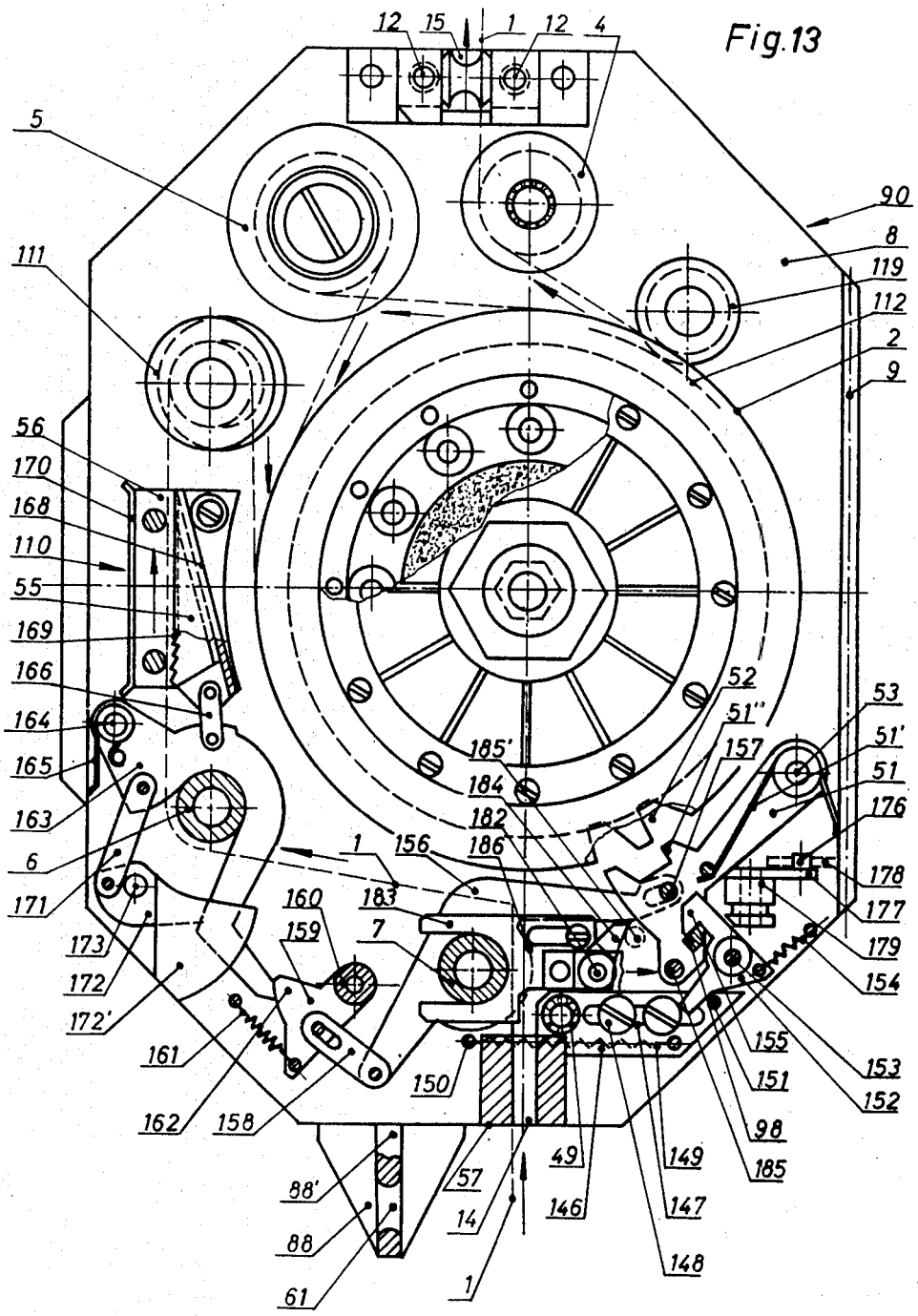
FIG. 13 shows a side view of FIG. 11, partially in a section.

Should, unexpectedly, the rope 1 be damaged over more than half of its diameter or even be torn or too short, futher roping down is immediately interrupted as soon as the damaged rope portion or the rope end is within the area of the inlet opening 14. For this purpose a rope monitoring device 46 is provided comprising a sensing lever 48 pivotally supported on the base plate 8 around an axis 47 at a position above the inlet opening 14. This sensing lever 48 has the shape of a crank lever and carries on one of its ends a sensing roller 49 being pressed against the rope 1 by means of a spring 50. The other end of the sensing lever 48 is given the shape of a lock pawl 51 engaging a serration or cogging 52 of the rope pulley 2 (FIG. 3) thus preventing any further rotation of the rope pulley 2 as soon as the sensing lever 58 can in case of a rope shortage perform a rotating movement. This rotating movement is transmitted on a wedge-like clamping piece 55 via a transmitting piece 54 pivotally supported on the axis 53 of the guide roll 7, said clamping piece 55 being movably supported within guideways 56 of the base plate 8 and clamping the rope 1 as soon as it becomes shifted by means of the transmitting piece 54 (FIG. 3). Conveniently, a leaf spring 58 is interpositioned between the transmitting piece 54 and the clamping piece 55 and pivotally arranged on a bolt 57 of the base plate 8. To improve the action exerted on the rope 1, the clamping piece 55 can be provided with transverse grooves, clamping noses 59 or the like.

For preventing any slip of the rope 1 on the rope pulley 2, the wedge-shaped groove 3 of the rope pulley 2 is provided with radially directed roughenings or ribs.

The base plate 8 and the cover plate 10 each are carrying a handle 60 on the outer side, which handle can be gripped by the person to be roped down. At least one of both plates 8 and 10, preferably the stronger base plate 8, is provided with an ear 61 for hooking therein a spring safety hook connected to a suspension band, for example a usual triple suspension band. The rack is further provided with rollers 62 (FIG. 1) protruding over the contour of the rack and being arranged at both sides of both plates 8, 10 and serving the purpose of passing the equipment over protrusions of the brick work in a shock-free manner.

It is convenient to fix on at least one of the handles 60 a loop into which the person to be roped down is putting its hand and which, after having grasped the handle 60, is tensioned and fixed to the upper end of the equipment.

The bearing bolts for the rope pulley 2 and for the guide pulleys 4 to 7 are arranged on threaded bolts, the pitch direction of which is the same as is the direction of rotation of the corresponding pulley on roping down operation. For instance, the rope pulley 2 is rotating on roping down operation (FIG. 1) in counter-clock-direction and is running on the supporting roll 1 supported on threaded bolts 16', in their turn fixed in the base plate 8 by a left-hand thread. This prevents the bearing bolts from leaving the base plate 8.

The operation of the equipment is as follows:

In case of a fire accident, the rope 1 is stationarily fixed with one of its ends, for example tied to the window frame. The other end of the rope is lowered through the window opening or the like or thrown therethrough. The rope shall contact with its free end the ground, noting that any surplus length is of no importance. The person to be rescued applies now the safety band and connects this band by means of the spring safety hook to the ear 61 of the equipment. After having opened the equipment by unlocking the locking lever 11, the rope 1 is gripped at that point contacting the edge of the outermost area of the window protrusion, the railing of a balcony or the like. With an additional length of approximately 0.5 m (measured in downward direction), this rope portion is put into the equipment at the exit opening 15, whereupon the rope is put on the guide pulleys 4, 5, the rope pulley 2 and the guide pulley 6,7 in the manner shown in FIG. 1 and passed out of the equipment through the inlet opening 14. Introducing the rope is facilitated by the wedge-shaped groove 3 of the rope pulley 2 and by the guide pulleys 4 to 7 which are equally given a groove profile. When putting the rope into the inlet opening 14, the sensing roller 49 must correspondingly be swivelled out of the path of the rope. After having checked correct positioning of the rope, the cover plate 10 is closed and locked by means of the locking lever 11. Prior to use, the equipment is as exactly as possible adjusted to the body weight of the person to be roped down by correspondingly rotating the actuating knob 32 and by the pivotal movement of the pivotal lever 26 resulting thereby. The life saving equipment is now ready for operation and the person to be roped down can allow himself to slide downwardly. If the speed of roping down movement is, according to the opinion of said person, too high this person can reduce this speed by exerting finger pressure to the adjusting lever 25. Too high a speed of roping down is prevented by the centrifugal force brake 33 and a torn rope or too short a rope has no consequences in view of the rope monitoring device 46. It is however adviseable to provide a knot at the lower end of the rope 1 which prevents at any rate that the rope 1 does completely pass through the equipment.

In the embodiment shown in the FIGS. 7 to 10, the rope 1 is passed over the rope pulley 2 for an angle of approximately 345°. On the side face of the rope pulley 2, which is remote from the base plate 8, a brake disc 64 for braking the rope pulley 2 is connected by means of screws 65. Each screw 65 is passed through the brake disc 64, a spacer disc 66 as well as the rope pulley 2 and is screwed into a toothed locking disc 67 located between the rope pulley 2 and the base plate 8 and contacting the rope pulley 2. Further, a flange 68 of a bushing 69 is screwed onto the inner side of the base plate 8 by means of six supporting screws 79 which simultaneously serve as guide means for compression springs 71 pressing an inner brake lining disc 72 against the brake disc 64. Pins of reduced diameter of the supporting screws 70 are introduced into positioning bores of the brake lining disc 72 such that the brake lining disc 72 is free for limited movement in axial direction. This results in a certain pre-braking action on the brake disc 64 and thus also on the rope pulley 2.

The bushing 69 is guiding a tension bolt 73 which is secured against rotation by a transverse bolt 25 engaging a milled groove 74 within the bushing 69. The tension bolt extends through the brake lining disc 72 and its brake lining 72', through the brake disc 64 and through a further brake lining 76' which is applied onto an outer brake lining disc 76 which in its turn is screwed onto an extension 73', which is of reduced diameter and provided with a thread, of the tension bolt 73, noting that the brake lining disc 72 can be shifted in axial direction of the tension spring. A supporting disc 77 is equally screwed onto said extension 73' and locked in position by a locking nut 78. Rotation of a nut 79, which is screwed onto a thread 80 of the tension bolt 73 and is supported on the front face of the bushing 69 by means of an anti-friction bearing 81, in clockwise direction (FIG. 10) by means of a handle 82 connected to this nut results therefore in a longitudinal shift of the tension bolt 73 whereby the brake lining disc 76 is firmly pressed with its brake lining 76' against the brake disc 64.

On a flange 79' of the nut 79 a carrier plate 83 (FIG. 10) for two ears 84 carrying the handle 82 is fixed with interposition of spacer discs. By means of a swing bolt 85 there is hingedly connected one end of a joint plate 86 between the flange 79' and the carrier plate 83, said joint plate 86 being hingedly connected with its other end via a swing bolt 87 to a slide 88 which is guided in guideways 89 on the outer side of the base plate 8 and is at the outer side of the rack 90 (FIG. 9) provided with the lug 61 for hooking therein the spring safety hook not shown of a six-fold suspension band. A strong tension spring 91 is fixed to the slide 88 and further fixed with its other end at 92 on the upper portion of the base plate 8. A further tension spring 93 forms an auxiliary spring which is fixed with one of its ends on the base plate 8 and with the other of its ends on the slide 88. A further auxiliary spring 94 is fixed with one of its ends to the base plate 8 and with the other of its ends to a tension flap 95 hingedly connected to the carrier plate 83. The arrangement is such that with non-loaded slide 88, i.e. with the slide 88 not extracted from the casing, the axis of the spring 94 and the axis of the tension flap 95 are not in line with each other but include an obtuse angle. For preventing oscillation of the tension flap 95, a further spring 96 is provided and fixedly arranged on the base plate 8. The spring 91 intends to pull the slide 88 and the handle 82 positively connected therewith in a predetermined position so that the braking force is always brought to a predetermined value if the equipment is not in use. If, however, the slide 88 is loaded by the body weight of the person to be roped down, the auxiliary spring 93 becomes at first active at a certain load and later on there becomes active the further auxiliary spring 94. The braking force acting on the rope pulley 2 is thus automatically adjusted according to the body weight of the person to be roped down.

The rope monitoring device 46 is also in this case provided with a sensing lever 48 pivotally supported on an axis 47 (FIG. 8), the sensing roller 49 of the sensing lever 48 being pressed against the rope 1 by means of a spring not shown. A locking pin rivetted to the sensing lever 48 in upright position is on normal rope diameter and during roping down operation within the path of movement of an upstanding bolt 98 which is pivotally supported for pivotal movement around an axis 99 on the base plate 8 or on the cover plate 10. As soon as the sensing lever 48 is allowed to perform around the axis 47 a pivotal movement in clockwise direction (FIG. 8), the locking pin 97 is sliding off the upstanding bolt 98 so that the locking pawl 51 is equally allowed to perform around axis 99 a pivotal movement in clockwise direction and said locking pawl can with its locking teeth engage the serration 52 of the locking disc 67 so that the rope pulley 2 is immediately secured against rotation. Simultaneously, the locking pawl 51 is shifting with its end 99' the transmission piece 54 slideably guided on the base plate 8 against a release lever 100 and is swivelling this release lever to such an extent that a nose 101 of this release lever 100 is sliding off a protrusion 102 of a locking disc 103 of the rope clamping device 110 so that said locking disc is given free and is allowed to perform a pivotal movement around an axis 105 unter the action of a spring 104 and can thus automatically exert a pressing force on the rope 1 which in its turn is pressed against the guide 56 so that the rope is retarded.

The guide pulley 6 can be subject to a slight braking action for more firmly pressing the rope 1 into the wedge-shaped groove 3 of the rope pulley 2. In addition, a roll 106 can be provided which is rotatably supported on a crank lever 107 in its turn pivotally connected to the sensing lever 48 around an axis 108 and being swivelled by means of a spring 109, which is fixed to the base plate 8, such that the roll 106 is pressed against the guide pulley 7', whereby the rope 1 is pressed into the wedge-shaped groove of this guide pulley 7'. This will increase the reduction of slip of the rope 1.

If the person to be roped down intends to change the speed of roping down movement, this can be effected by rotating the handle 82, noting that rotation in clockwise direction will reduce and rotation in counterclockwise direction will increase said speed. The rope pulley 2 can even be braked down to complete standstill.

The rope need not be a hemp rope at any rate and a steel cable or optionally even a chain could be used in place thereof.

In the embodiment according to FIGS. 11 to 18, the rope pulley 2 is provided with two adjacent wedge-shaped grooves 3 and 3' which are passed by the rope 1 one after the other. The rope 1 is entering the rack 90 through the entrance opening 14, is passing the sensing roll 49 contacting the rope circumference and is, relative to FIG. 13, passing over the right-hand side of the guide pulley 7 from where the rope is running in direction of the arrow to the guide pulley 6 which is passed by the rope 1 at the left-hand side. Subsequently the rope is running past the rope clamping device 110 and is then running over a further guide pulley 111 which is bearingly supported on the base plate 8 in an oblique position. The rope 1 is running over the guide pulley 111 for one half right-hand revolution and is then guided to the outer wedge-shaped groove 3' of the rope pulley 2. The rope is running in this wedge-shaped groove 3' with a looping angle of approximately 270° and is then running from the rope pulley 2 to the guide pulley 5 which is designed as twin guide pulley over which the rope is running twice in right-hand rotation. The rope is running from the guide pulley 5 to the wedge-shaped groove 3, which is more inwardly located, of the rope pulley 2 and is running over this rope pulley 2 again for a looping angle of approximately 270°. Subsequently, the rope 1 is running off the rope pulley 2 and is guided by means of the guide pulley 4 to a guide block 12 provided with four rolls. The screws 65, which fix the brake disc 64 to the base plate 8, simultaneously serve as fixing means for the toothed locking disc 67 and a further ring gear 112. The supporting screws 70 for fixing the flange 68 of the bushing 69 simultaneously serve as axes for the supporting rolls 16. The inner brake lining disc 72 is pressed against the brake disc 64 by means of one single helical compression spring 71 which is with this embodiment seated in a recess of the bushing 69. The outer brake lining disc 76 has a hexagonal recess 113 at its outer side accommodating as locking nut a hexagonal flange 78 of the tension bolt 73. The nut 79 screwed onto the thread 80 of the tension bolt 73 is supported against the base plate 8 and the bushing 69, respectively, with interposition of an anti-friction bearing 81. The slide 88 coupled to the nut 79 is also with this embodiment loaded by a spring 91, one end of which is fixed to the base plate 8 by means of a hinged joint 91' and the other end of which is connected via a hinged joint 115 with a flexible tension member 114 which has the shape of a roller chain. The tension member 114 is guided over part of the circumference of the nut 79, (FIG. 12) said circumference being provided with a cogging 116 engaging the individual chain links of the tension member 114. Extracting the slide 88 from the guideway 89 of the rack 90 against the force of the spring 91 will thus effect rotation of the nut 79. The tension bolt 73 can, however, not follow this rotational movement in view of its being guided with its hexagonal circumference (FIG. 13) within an equally hexagonal central opening of the bushing 69 for being shifted in longitudinal direction, said bushing 69 being screwedly fixed on the rack 90. Rotation of the nut 79 in clockwise direction (FIG. 12) during extracting the slide 88 from the rack 90 will thus effect a longitudinal shift of the tension bolt 73 in left-hand direction (FIG. 11), whereby the brake linings 72' und 76' rivetted on the constructional parts 72 and 76 are pressed against the brake disc 64. This does result in a braking force which is automatically adjusted according to the body weight of the person to be roped down because this braking force becomes the greater the greater is the weight of said person and the more the slide 88 is extracted from the rack 90 against the force of the spring 91, respectively. With the extracting force ceasing, the slide 88 is retracted into the rack 90 and its guideway 89, respectively, under the influence of the spring 91 until an abutment 88' of the slide 88 is contacting the lower rim 90' of the rack 90.

The circumference of the nut 79 does not wholly follow the arc of a circle but has a flattening 117 reaching till near the axis 118 of the nut 79. This flattening 117 is not provided with a cogging 116 (FIG. 12) and has as an effect that with great extracting strokes of the slide 88, i.e. with great body weight of the person to be roped down, the distance h (FIG. 12), of the circumference of the nut 79 from its rotational center (axis 118), i.e. the lever arm via which the spring 91 tends to rotate the nut 79 opposed to clockwise direction, becomes smaller.

Figure 16:
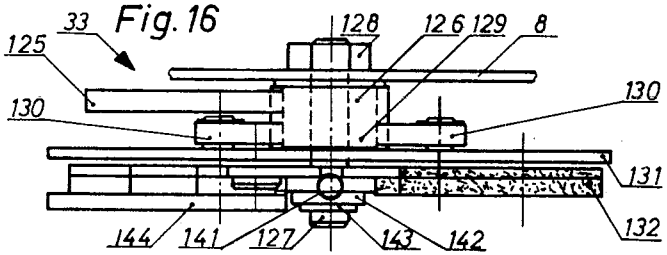
FIG. 16 is a top plan view of FIG. 15.

With high loads to be roped down, the spring 91 is thus acting on the nut 79 with a shorter lever arm h. In this case, the arrangement is such that even with the maximum extracting position of the slide 88, which extracting position is delimited by a further abutment 88'' of the slide 88, the braking force generated on rotating the nut 79 and acting on the brake disc 64 will only amount to 95% of the braking force required for completely stopping the roping down equipment. Thus it is prevented that the equipment is unvoluntarily brought to stand-still with high loads to be roped down. A centrifugal force brake 33 (FIGS. 12 and 14 to 18) is provided to avoid in this case that with high loads to be roped down the speed of roping down becomes too high, said centrifugal force brake 33 being non-rotationally connected with the rope pulley 2 and being in the position to effect complete stand-still of the roping down equipment. This centrifugal force brake 33 is driven by the gear 112 (FIG. 11) which is non-rotationally connected with the rope pulley 2 and is meshing with a spur gear 119, the shaft of which extends through the base plate 8 and carries on its outside a further spur gear 120 which forms the first stage of a multiple-stage transmission gear to high numbers of revolution. For this purpose, the spur gear 120 meshes with a smaller spur gear 121 arranged on the shaft of a greater spur gear 122 which in its turn meshes with a smaller spur gear 123 (FIG. 12) arranged on the shaft of a greater spur gear 124. The last mentioned spur gear is driving via two further spur gears 125, 126, the axis 127 of the centrifugal force brake 33. All spur gears 120 to 126 are bearingly supported on the base plate 8 to which also the axis 127 is screwed by means of a nut 128 (FIG. 16). The spur gear 126 is free for rotation on the axis 127 and is in engagement not only with the spur gear 125 but also, via a notched rim 129 (FIGS. 15 and 16), with two lock pawls 130 pivotally supported on a carrier plate 131 rotatably arranged on the axis 127 and pressed by means of springs into the notches or rests of the notched rim 129. Further, two brake lining carriers 132 (FIGS. 14, 15 and 16) are pivotally supported for pivotal movement around axes 133 on the carrier disc 131 and two transmission levers 134 are pivotally supported around axes 135 on the carrier disc 131. Said transmission levers 134 are provided adjacent to their pivotal point on the corresponding axis 135 with a rounded protrusion 136 contacting the rear side of the adjacent brake lining carrier 132 and being shaped such that on pivoting the transmission lever 134 around its pivotal axis 135 in clockwise direction the brake lining of the respective brake lining carrier 132 is pressed against the inner circumference 137 of an annular housing 138 (FIGS. 17 and 18), said annular housing 138 being screwed onto the base plate 8 by means of screws extending through a flange 139 and being laterally provided with an opening 140 through which the spur gear 125 can extend into the interior of the annular housing 138 for meshing with the spur gear 126.

Each brake lining carrier 132 is further hingedly connected to a tension spring 141, the other end of which is hung into an opening of a disc 142 rotatably put on the axis 127. A circlip lock ring 143 prevents the disc 142 from leaving the shaft 127 and simultaneously the axis 127 from any axial shift.

With normal body weight of the person to be roped down the braking force automatically exerted on the brake disc 64 is sufficient to attain the desired speed of roping down movement. If, however, the load to be roped down is too great, the tension spring 91 becomes effective with a shorter lever arm h so that there remains even with completely extracted slide 88 a residual force which is automatically assisted by the centrifugal force brake 33 such that the desired speed of roping down movement will be adjusted. If, in this case, the rotational speed of the carrier disc 131 on the axis 127 becomes greater, both brake lining carriers 132 are rotated around their pivotal axes 133 in outward direction under the influence of the centrifugal force so that the brake linings begin to contact the inner wall of the housing against the action of the springs 141. This is assisted by the fact that the transmission levers 134, which may be provided with load weights 144, are beginning with their pivotal movement around their pivotal axes 135 and thus are pressing their protrusions 136 against the rear surfaces of the brake lining carriers 132 and thus are also actuating the brake linings. On increasing pivotal movement of the transmission levers 134, the brake linings of the brake lining carriers 132 are still stronger pressed against the braking surface of the annular housing 138.

If the movement of the life saving equipment in longitudinal direction of the rope is suddenly interrupted, for example because the rope monitoring device 46 detects the end of the rope entering the equipment or detects a rope constriction, rotational movement of the rope pulley 2 is interrupted what has as a consequence the interruption of the rotational movement of the spur gear 126 and thus also of the notched rim 129. In view of the inertia of the carrier plate 131 and of the constructional parts carried by this disc, the carrier disc 131 further rotates in direction of the arrow 145 (FIGS. 14 and 15), noting that the chamferred teeth of the lock pawl 130 are lifted out of the notches of the notched rim 129 against the action of the pressing springs acting on said locking pawls 130. The carrier disc 131 and the constructional parts carried by this disc are thus allowed to freely rotate till standstill so that neither the centrifugal force brake 33 can be damaged nor any teeth of the transmission gear 119 to 126 can be sheared off.

In this embodiment, the rope monitoring device 46 has its function derived from the sensing roll 49 rotatably supported on a slide 146 in its turn being slidably guided by means of a bolt 148 engaging a longitudinal slot 147 of the base plate 8 and being pulled in left-hand direction (FIG. 13) by means of a spring 149 fixed at 150 to the bottom of the rack so that the sensing roll 49 is at any time pressed against the rope 1. The slide 146 carries a bolt 151 contacting a leg of a locking lever 152 in its turn pivotally supported on the base plate 8 around an axis 153 and loaded by a spring 154 fixed to the base plate 8 in a sense of rotating in counter-clockwise direction around the axis 153 so that the leg of the locking lever 152 is contacting the bolt 151 under pre-stress. The locking lever 152 is provided with a nose 155 which, on normal operation, is slipping behind a protrusion 98 of a locking pawl 51 in its turn being pivotally supported on the base plate 8 around the axis 53 and being loaded by a spring 51' in the sense of clockwise rotation around the axis 53. The locking pawl 51 carries two teeth 51'' engaging the cogging 52 of the locking disc 67 connected to the rope pulley 2 and can thus block rotation of the rope pulley 2.

The pivotal movement of the lock pawl 51 resulting by blocking the rotation is transmitted via a release lever 156 which surrounds with an elongated hole a bolt 157 of the lock pawl 51 and is pivotally supported on the base plate 8 around the axis of the guide pulley 7. This release lever 156 is, via a flap 158 hingedly connected to this release lever, in connection with a further locking lever 159 pivotally supported on the base plate 8 around an axis 160 and loaded by a spring 161 anchored on the base plate in the sense of pivotal movement in clockwise direction around the axis 160. This locking lever 159 blocks with a nose 162 the end of a wedge shifting lever 163 being pivotally supported on the base plate 8 around an axis 164 and being loaded by a spring 165 in the sense of a pivotal movement in counter-clockwise direction around this axis. The wedge shifting lever 163 is connected with a wedge-shaped clamping piece 55 by means of a flap 166 and said clamping piece can be shifted along a wedge-like tapering wall 168 of the guideways 56 fixed to the base plate 8 such that the clamping piece 55 is pressed with a serration 169 against the surface of the rope 1 and is thus clamping the rope which is supported by a supporting wall 170 of the rope clamping device 110. To allow to restore the original position of the rope clamping device after any response thereof, the wedge shifting lever 163 is hingedly connected to a flap 171 in its turn hingedly connected to a restoring lever 172 pivotally supported on the base plate 8 around an axis 173. As soon as the rope clamping device 110 has given a response, this restoring lever 172 extends through a slot (not shown) of the cover out of the housing. If it is intended to release the rope clamping device after the roped down person is saved is only required to again press into the housing of the equipment the portion of the restoring lever 172 which protrudes from said slot.

Figure 19:
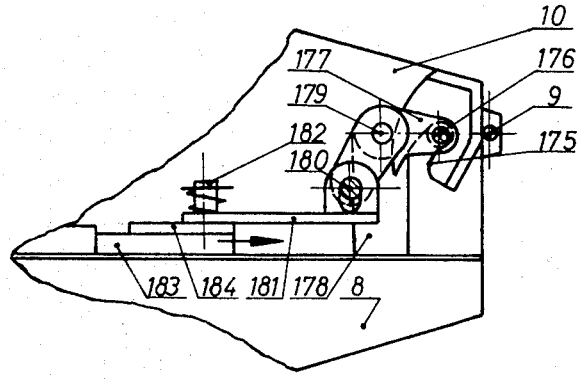
FIG. 19 shows a detail in a side view.
Figure 14:
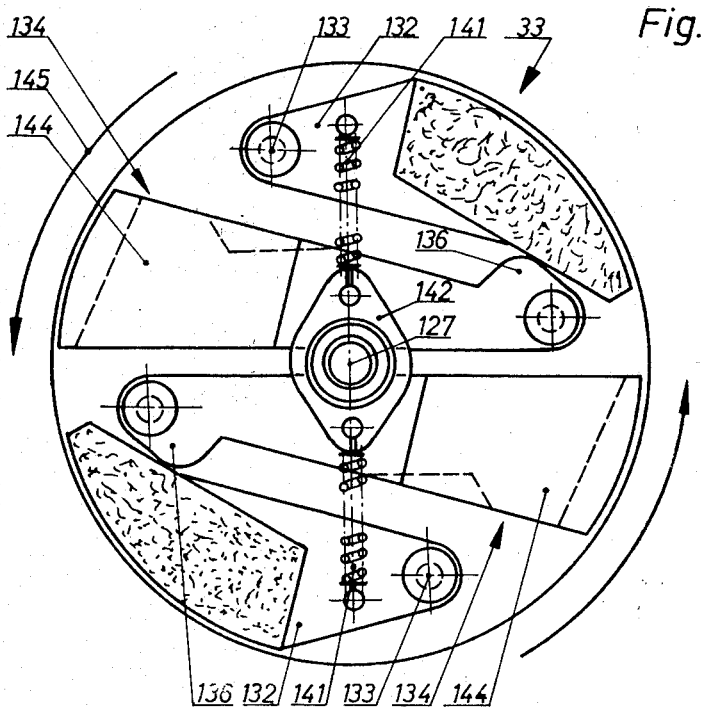
FIG. 14 shows a centrifugal force brake with its housing removed.
Figure 17:
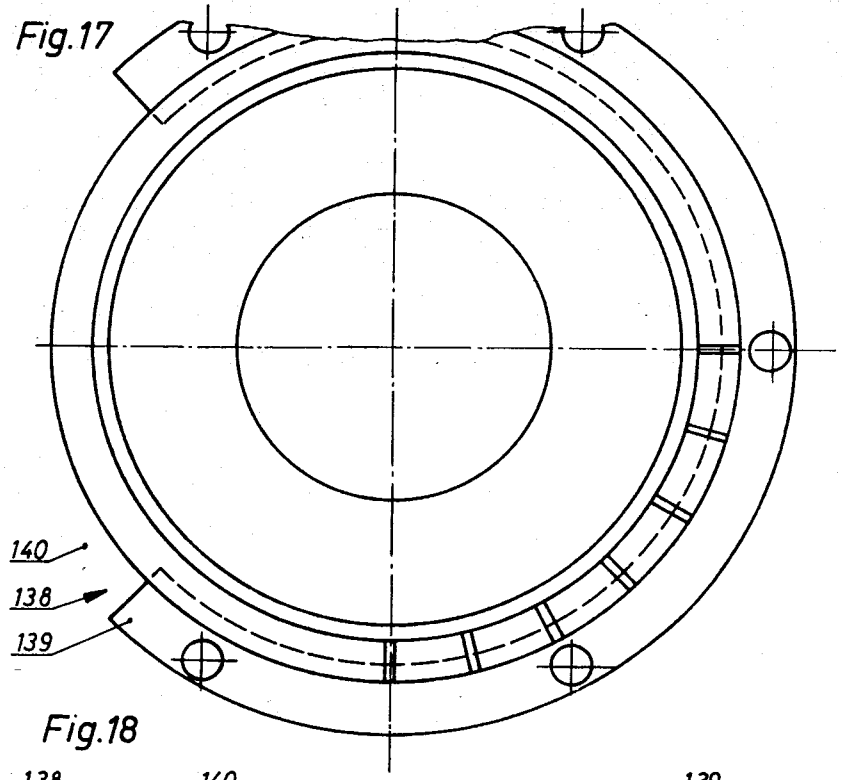
FIGS. 17 and 18 show the housing for the centrifugal force brake in a view and in a section, respectively, of FIG. 17.
Figure 18:
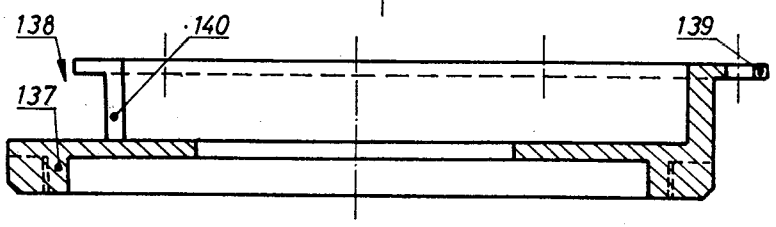
Figure 15:
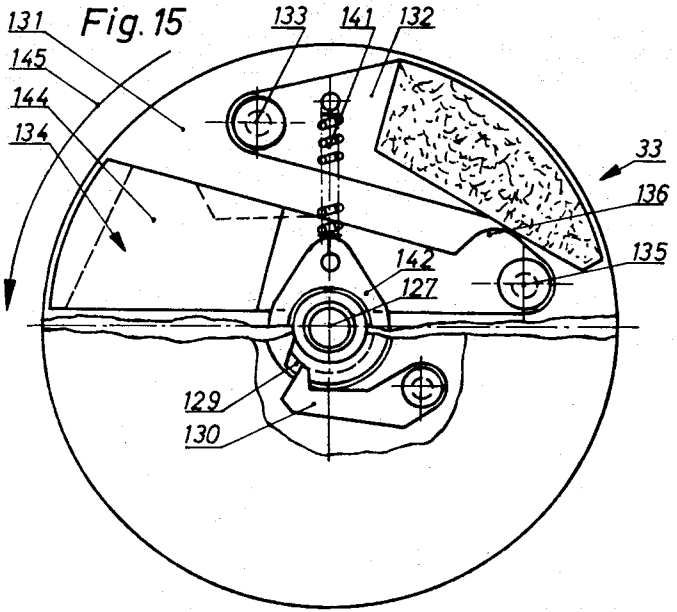
FIG. 15 shows a detail of this centrifugal force brake in a vertical cross section.

The equipment is further designed such that on opening the cover plate, which contacts the base plate 8 along the gap 187, the whole rope monitoring device, i.e., the constructional parts actuated by the sensing roll 49, are automatically returned in their starting position. For this purpose, a wind-up curve 175 is connected with the cover plate 10 (FIG. 19) pivotable around the axis of the hinge 9. A bolt 176 of a two-arm pivotal lever 177 is guided within the slot-shaped opening of the wind-up curve 175, said pivotal lever 177 being pivotally supported around an axis 179 of a bearing block 178 of the base plate 8 and carrying on its other arm a bolt 180 which can slide within an elongated slot of a tension piece 181. The tension piece 181 is resiliently seated on a bolt 182 (FIG. 19) of a wind-up slide 183 (FIG. 13), noting that between this wind-up slide 183 and the tension piece 181 a wind-up curve 184 is provided which is fixed to the wind-up slide 183. If the pivotal lever 177 pulls the tension piece 181 in right-hand direction (FIGS. 13 and 19), the wind-up curve 184 rivetted onto the wind-up slide 183 pulls with it, and this with its protruding nose, a tension roll 185 (which in just this moment assumes the position 185' shown in dashed lines, FIG. 13) and rotates the lock pawl 51 around its pivotal axis 53 out of its locking position. During this movement the protrusion 98 of the lock pawl 51 is sliding on the chamferred front face of the nose 155 of the locking lever 152 until this nose 155 can snap behind the protrusion 98 under the action of the spring 154 until the locking pawl 51 is blocked in its position removed from the cogging 52. Simultaneously, on shifting the wind-up slide 183, this slide is pressing with a stepped portion 186 against the left-hand side surface (FIG. 13) of the slide 146 because both slides 146, 183 are located in the same plane. The slide 146 is thus returned in the wind-up position against the force the spring 149 and maintained in this position as long as the cover plate 10 assumes open position. After having put the rope in position, the pivotal lever 177 is, during closing the cover plate 10 and prior to locking same, returned by the wind-up curve 174 in its rest position shown in FIG. 19, whereby the tension piece 181 and therewith also the wind-up curve 184 and the wind-up slide 183 are shifted in left-hand direction to such an extent that the slide 147 can be moved under the action of the spring 149 in left-hand direction until the sensing roll 49 contacts the rope circumference. The bolt 151 of the slide 146 is always located at the right-hand side (FIG. 13) of the locking lever 152 so that the locking lever 152, which prevents the lock pawl 51 from engaging the cogging 52, is not swivelled out of its locking position. This is, however, only effected when the sensing roll 49 can move for a corresponding distance in left-hand direction, for example when the rope end has entered the equipment or when a rope constriction has been detected. The sensing roll 49 does thus not form an obstacle for positioning the rope because said sensing roll is retracted by the slide 146 on moving the cover plate in open position.

The running path of the rope through the equipment is indicated by arrows.

If the rope should be too short for allowing the person to be roped down to reach the ground, it is immediately detected that the lower end of the rope enters the inlet opening or passes past the sensing roll 49 so that, on the one hand, the rope clamping device 110 gives a response and reliably clamps the rope end and, on the other hand, and simultaneously therewith, further rotation of the rope pulley 2 and of the brake disc connected therewith is prevented by the lock pawl 51. In view of the rope pulley 2 carrying two windings of the rope 1, any slip of the rope within the wedge-shaped grooves 3, 3' is impossible. The person to be roped down is thus reliably secured against precipitation. In view of the equipment not requiring any manipulation by the person to be roped down if the equipment has been correspondingly prepared for operation (correct positioning of the rope), functional defects resulting from a wrong action is impossible. In view of the correct speed of the roping down movement being automatically adjusted, the equipment, which is primarily intended for roping down persons in dangerous situations, is also suitable for roping down goods of any kind.

What is claimed is:

1. A life saving equipment for roping down persons along a rope, comprising a rack being passed by the rope and being connectable to the person to be roped down, a rope pulley being rotatably supported within said rack and being provided on its circumference with a rope groove for said rope which is guided within said rope groove for a looping angle of more than 180°, at least one brake member being provided for being pressed against the rope pulley for braking said rope pulley, a setting mechanism for adjusting the braking force of said brake member by the person to be roped down, and a monitoring means checking the presence of the rope within said rack, said monitoring means having a sensor member being movably supported by said rack and pressed against the rope, which sensor member is operatively connected to a rope clamping device for clamping the rope in case of a rope shortage.

2. An equipment as claimed in claim 1, wherein said rope monitoring means is arranged at that area of the rack where the rope enters the rack.

3. An equipment as claimed in claim 1, wherein said sensor member is pressed against the rope by at least one spring.

4. An equipment as claimed in claim 1, wherein said rope monitoring means is further operatively connected to a lock pawl engaging a cogging of the rope pulley for fixing said rope pulley.

5. An equipment as claimed in claim 1, wherein said sensor member is operatively connected to said rope clamping device via a transmission piece and a compression spring.

6. An equipment as claimed in claim 4, further comprising a slide actuated by a cover plate of said rack for lifting said sensor member off the rope and for swivelling said lock pawl out of the cogging of the rope pulley.

7. An equipment as claimed in claim 6, further comprising a wind-up curve fixed on the cover plate, said wind-up curve, on movement of the cover plate, changing the position of said slide via a pivotal lever, said slide acting on a further slide carrying a roller forming said sensor member.

8. An equipment as claimed in claim 7, wherein said slide to be changed in position by said wind-up curve carries a further wind-up curve which on shifting movement of the slide engages a tension roller of said lock pawl and thus swivels the lock pawl out of engagement with the cogging of the rope pulley.

9. An equipment as claimed in claim 1, further comprising a resetting means operatively connected to the rope clamping device.

10. An equipment as claimed in claim 9, characterized in that the rope clamping device has a wedge-shaped clamping piece, a resetting lever being provided for returning said clamping piece, said resetting lever protruding from the rack with the clamping piece assuming the clamping position for the rope.

11. An equipment as claimed in claim 10, wherein the resetting lever is connected via a flap to a wedge shifting lever shifting the clamping piece.

12. An equipment as claimed in claim 1, wherein the rope clamping device is arranged at a position of the rack which is remote from a rope inlet opening of the rack.

13. An equipment as claimed in claim 1, wherein the setting mechanism varying the braking force is provided with a tension bolt extending outwardly from the rack and pressing on movement in axial direction brake lining discs against a brake disc non-rotatably connected to the rope pulley, a nut being provided for moving the tension bolt, said nut being screwed onto a thread of the tension bolt and being supported on an abutment connected to the rack, said nut being coupled to an adjusting member being movable relative to the rack and being acted upon by the body weight of the person to be roped down against the action of a spring.

14. An equipment as claimed in claim 13, wherein the abutment is formed by a bushing surrounding the tension bolt.

15. An equipment as claimed in claim 13, wherein said movable adjusting member is a slide guided relative to the rack.

16. An equipment as claimed in claims 13 or 15, wherein said nut is coupled with the slide by means of a joint flap.

17. An equipment as claimed in claim 13, wherein a handle for the person to be roped down is non-rotatably connected with said nut.

18. An equipment as claimed in claim 13, wherein one end of at least one tension spring is fixed to the nut or to the handle and the other end of said spring is fixed to the rack.

19. An equipment as claimed in claim 13, wherein the adjusting member loaded by the body weight of the person to be roped down is connected with the nut via a flexible tension member which is put over the circumference of the nut and is non-movably connected with this circumference and is with its other end connected to said spring, noting that the circumference of the nut has a distance from the axis of the tension bolt which becomes smaller in direction to that end of the rotational path of the nut which is coordinated to high loads to be roped down so that within this rotational path the spring is acting on the nut with a shortened lever arm.

20. An equipment as claimed in claim 19, wherein said tension member is a roller chain, the chain links of which engage a cogging arranged on the circumference of the nut.

21. An equipment as claimed in claim 19, wherein the braking force generated at the end of the rotational path of the nut amounts only to a major portion of the braking force required for stand-still of the rope pulley, a centrifugal force brake being provided which is non-rotatably connected to the rope pulley for applying the residual braking force required for completely blocking the rope pulley.

22. An equipment as claimed in claim 21, wherein a notched rim is connected with the rope pulley, said notched rim is coaxially arranged relative to the nut and drives the centrifugal force brake via a transmission gear increasing the numer of revolutions.

23. A lifesaving equipment for roping down persons by means of a rope, comprising a rack being passed by a rope, a rope pulley being rotatably supported within said rack and being provided on its circumference with a rope groove for said rope which is guided within said rope groove for a looping angle of more than 180°, at least one brake member being provided for being pressed against the rope pulley for braking said rope pulley, a setting mechanism for adjusting the braking force of said brake member by the person to be roped down, and a monitoring means checking the presence of the rope within said rack, said monitoring means having a sensor member being movably supported by said rack and pressed against the rope, which sensor member is operatively connected to a rope clamping device for clamping the rope in case of a rope shortage.

* * * * *